US010146160B2

(12) United States Patent
Kondo

(10) Patent No.: US 10,146,160 B2
(45) Date of Patent: Dec. 4, 2018

(54) FIXING DEVICE AND IMAGE FORMING APPARATUS

(71) Applicant: KYOCERA Document Solutions Inc., Osaka (JP)

(72) Inventor: Akihiro Kondo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/835,516

(22) Filed: Dec. 8, 2017

(65) Prior Publication Data

US 2018/0164721 A1 Jun. 14, 2018

(30) Foreign Application Priority Data

Dec. 14, 2016 (JP) ..... 2016-241932

(51) Int. Cl.
*G03G 15/20* (2006.01)

(52) U.S. Cl.
CPC ..... *G03G 15/2039* (2013.01); *G03G 15/2017* (2013.01); *G03G 15/2032* (2013.01); *G03G 15/2064* (2013.01)

(58) Field of Classification Search
USPC ..... 399/38, 67, 69, 107, 110, 122, 320, 328, 399/330, 331
See application file for complete search history.

(56) References Cited

U.S. PATENT DOCUMENTS 8,918,003 B2 * 12/2014 Kawai ..... G03G 15/2039 399/69
9,207,304 B2 * 12/2015 Haynes ..... G01S 5/0205
9,244,431 B2 * 1/2016 Kikushima ..... G03G 21/206
9,316,967 B2 * 4/2016 Fukai ..... G03G 15/2067

FOREIGN PATENT DOCUMENTS

JP 2013-120314 A 6/2013

* cited by examiner

*Primary Examiner* — Hoan Tran
(74) *Attorney, Agent, or Firm* — Studebaker & Brackett PC

(57) ABSTRACT

A fixing device includes a heating body, a heating source, a pressuring body, a driving source, a moving part and a cooling part. The driving source rotates one body of the heating and pressuring bodies. The moving part moves the pressuring body relatively to the heating body at timing after the medium passes the nip between the heating and pressuring bodies to separate the pressuring body from the heating body. The cooling part cools the pressuring body separated from the heating body. If fixing operation is carried out when a specific value obtained in the last fixing operation by dividing a passing period of the medium through the nip by a rotating period of the one body, is smaller than a reference value, the timing is made early in comparison with a case where the specific value is equal to or more than the reference value.

18 Claims, 16 Drawing Sheets

FIXING DEVICE AND IMAGE FORMING APPARATUS

INCORPORATION BY REFERENCE

This application is based on and claims the benefit of priority from Japanese Patent application No. 2016-241932 filed on Dec. 14, 2016, the entire contents of which are incorporated herein by reference.

BACKGROUND

The present disclosure relates to a fixing device and an image forming apparatus.

For example, a fixing device including a rotatably provided fixing member, a heating means heating the fixing member, a rotatably provided pressuring member, and a cooling means is known. The pressuring member comes into pressure contact with the fixing member to form a nip part with the fixing member. The cooling means comes into contact with a surface of the pressuring member and has an absorbing member absorbing heat of the pressuring member to cool the pressuring member. The fixing device makes a recording medium pass through the nip part and makes a toner image on the recording medium fix onto the recording medium by heat and pressure. Then, in the above-mentioned fixing device, when a contact/separate means contacting and separating the pressuring member with respect to the fixing member separates the pressuring member from the fixing member, the pressuring member is cooled by absorbing heat of the pressuring member with the absorbing member.

Incidentally, in a case of a conventional fixing device, a toner offset and adhered from the medium to the fixing member at the nip part may be moved to the pressuring member at the nip part. Then, if the toner moved from the heating member is naturally cooled while adhering to the pressuring member, in a case where fixing operation is carried out this time, it is feared that the toner adhered to the pressuring member is moved to the fixing member at the nip part, transferred and fixed to a fixing face of the medium on which the toner image is fixed, and then, fixing failure occurs.

SUMMARY

In accordance with an embodiment of the present disclosure, a fixing device includes a heating body, a heating source, a pressuring body, a driving source, a moving part and a cooling part. The heating body is rotated and contacts with a medium, on which a toner image is formed, to heat the medium. The heating source gives heat for heating the medium by the heating body to the heating body. The pressuring body is rotated and forms a nip with the heating roller to pressure the medium passing through the nip. The driving source rotates one body of the heating body and the pressuring body. The moving part moves the pressuring body relatively to the heating body at a predetermined timing after the medium passes through the nip to separate the pressuring body from the heating body. The cooling part cools the pressuring body at a position where the pressuring body is separated from the heating body. In a case where fixing operation is carried out in a condition that a specific value, which is obtained in the last fixing operation by dividing a passing period when the medium passes through the nip by a rotating period when the one body is rotated by the driving source, is smaller than a predetermined reference value, the timing is made early in comparison with a case where the specific value is equal to or more than the reference value.

alternatively, in accordance with an embodiment of the present disclosure, a fixing device includes a heating body, a heating source, a pressuring body, a driving source, a moving part, and a cooling part. The heating body is rotated and contacts with a medium, on which a toner image is formed, to heat the medium. The heating source gives heat for heating the medium by the heating body to the heating body. The pressuring body is rotated and forms a nip with the heating roller to pressure the medium passing through the nip. The driving source rotates one body of the heating body and the pressuring body. The moving part moves the pressuring body relatively to the heating body at a predetermined timing before the medium reaches the nip to contact the pressuring body with the heating body. The cooling part cools the pressuring body at a position where the pressuring body is separated from the heating body. In a case where fixing operation is carried out in a condition of being carried out within a predetermined period from completion of the last fixing operation, the timing is made late in comparison with a case where a period from completion of the last fixing operation to this time is longer than the predetermined period.

In accordance with an embodiment of the present disclosure, an image forming apparatus includes a forming part forming a toner image onto a medium; and the above-described fixing device heating and pressuring the medium, on which the toner image is formed by the forming part, to fix the toner image onto the medium.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
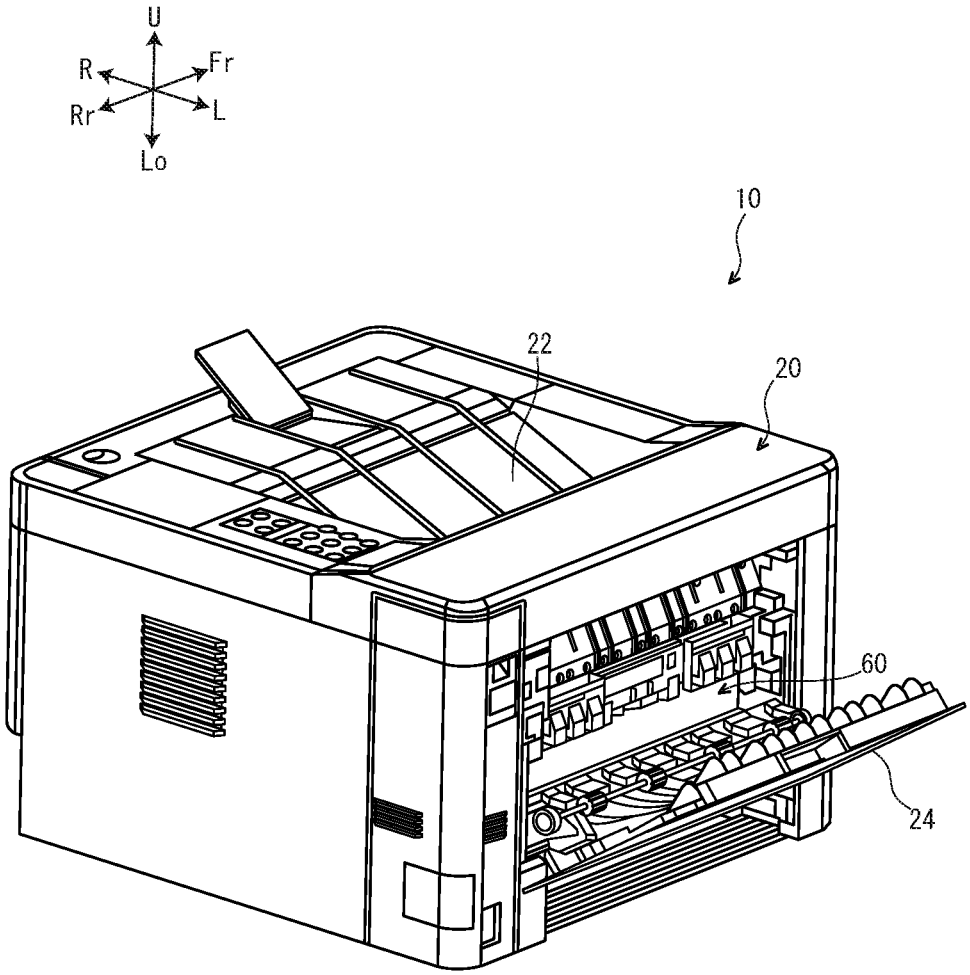
FIG. 1 is a perspective view showing an image forming apparatus according to a first embodiment of the present disclosure.

Hereinafter, a first embodiment, a second embodiment, a third embodiment and modified examples will be described in order.

First, entire structure of an image forming apparatus 10 (refer to FIGS. 1 and 2) and image forming steps of the image forming apparatus 10, structure and fixing steps of a fixing device 60 (refer to FIGS. 4A and 4B) as a main component of the embodiments, and effects of the embodiments will be described in order.

In the present specification, arrows Fr and Rr in the drawings respectively correspond to a near side and a far side in an apparatus depth direction, arrows R and L in the drawings respectively correspond to a right side and a left side in an apparatus width direction, and arrows U and Lo in the drawings respectively correspond to an upper side and a lower side in an apparatus height direction. The specification will be described so that a state of the image forming apparatus 10 as viewed from the near side in the apparatus depth direction is estimated to be a front side of the image forming apparatus 10.

Figure 2:
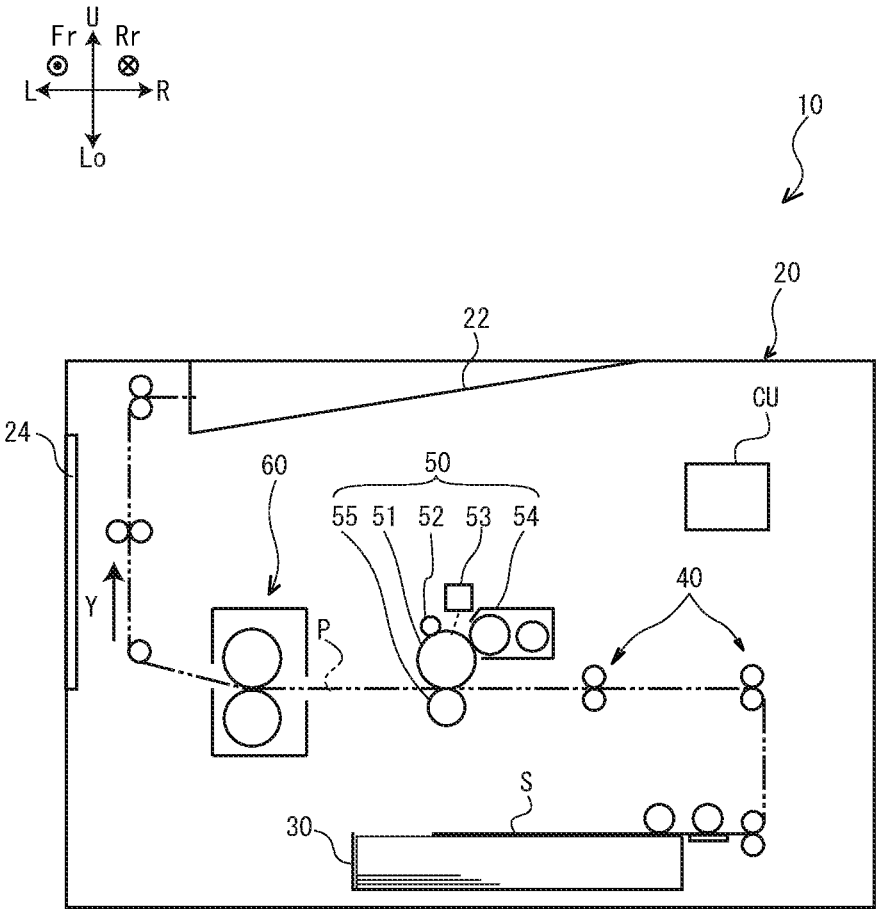
FIG. 2 is a front sectional view schematically showing the image forming apparatus according to the first embodiment.

The entire structure of the image forming apparatus 10 will be described with reference to FIGS. 1 and 2. The image forming apparatus 10 is an electrographic type apparatus configured to include a main body 20, a sheet feeding cartridge 30, a conveying device 40, a toner image forming part 50 (one example of a forming part), the fixing device 60 and controlling part CU.

The main body 20 has a function housing the sheet feeding cartridge 30, the conveying device 40, the toner image forming part 50, the fixing device 60 and controlling part CU in its inside. The main body 20 is a box-like exterior. A part of an upper face of the main body 20 is an ejection tray 22 onto which a medium S having a fixed toner image (having a formed image) is ejected. Incidentally, in a left end face of the main body 20 as viewed from the front side, a lid part 24 is arranged and, to the main body 20 in a state that the lid part 24 is laid on its side (refer to FIG. 1), the fixing device 60 described later is attachable/detachable.

The sheet feeding cartridge 30 is located at a lower side in the main body 20 and stores stacked mediums S onto which an image is formed. The conveying device 40 has a function conveying the medium S stored in the sheet feeding cartridge 30 from the sheet feeding cartridge 30 to the ejection tray 22 along a conveying path P. The conveying device 40 includes a plurality of following rollers and driving rollers, and a driving source (not shown) driving the plurality of driving rollers. Here, a direction indicated by arrows Y in the drawings is a conveying direction of the medium S.

The toner image forming part 50 has a function forming a toner image onto the medium S conveyed by the conveying device 40. The toner image forming part 50 is located at a center inside the main body 20 as viewed from the front side. The toner image forming part 50 is configured to include a photosensitive body 51, a charging device 52, an exposing device 53, a developing device 54 and a transferring roller 55.

The toner image forming part 50 has a function electrically charging the photosensitive body 51 rotating around an axis by the charging device 52, exposing the photosensitive body 51 by the exposing device 53 to form a latent image, developing the latent image to the toner image by the developing device 54, and transferring the toner image onto the medium S by the transferring roller 55. As described above, the toner image forming part 50 forms the toner image onto the medium S.

The fixing device 60 has a function fixing the toner image onto the medium S on which the toner image is transferred by the toner image forming part 50 (the medium having the formed toner image). The fixing device 60 is located at a left side inside the main body 20 as viewed from the front side. Because the fixing device 60 is a main component of the embodiment, detail structure of the fixing device 60 will be described later.

The controlling part CU has a function receiving image data from an external device (refer to FIG. 3) and controlling each component composing the image forming apparatus 10 on the basis of the image data. A detail function of the controlling part CU will be described in the later description of the image forming steps and the fixing steps.

Next, the image forming operation of the image forming apparatus 10 of the embodiment will be described with reference to FIGS. 1 and 2.

First, the controlling part CU, when receiving image data from the external device (refer to FIG. 3), operates the toner image forming part 50. Concretely, the controlling part CU transmits a remote signal for forming the toner image to the toner image forming part 50 (refer to FIG. 3). As a result, the charging device 52 electrically charges the photosensitive body 51, the exposing device 53 exposes the photosensitive body 51 to form the latent image, and the developing device 54 develops the latent image to the toner image, and thereby, the toner image is formed on the photosensitive body 51.

Moreover, the controlling part CU transmits a remote signal for conveying the medium S to the conveying device 40. Then, the conveying device 40 sends the medium S to a transferring position in accordance with a timing when the toner image formed on the photosensitive body 51 reaches at the transferring position (a part where the photosensitive body 51 and the transferring roller 55 come into contact with each other) by rotation of the photosensitive body 51 around the axis. As a result, the transferring roller 55 transfers the toner image formed on the photosensitive body 51 to the medium S to form the toner image onto the mediums.

Subsequently, the controlling part CU transmits a remote signal for fixing the toner image onto the medium S to the fixing device 60. Then, the fixing device 60 fixes the toner image transferred on the medium S by the transferring roller 55 onto the medium S. After that, the medium S having the fixed toner image, i.e., the medium S having the formed image is ejected onto the ejection tray of the man body 20 at a downstream side from the conveying device 40 in the conveying direction, and then, the image forming steps are completed.

Figure 4A:
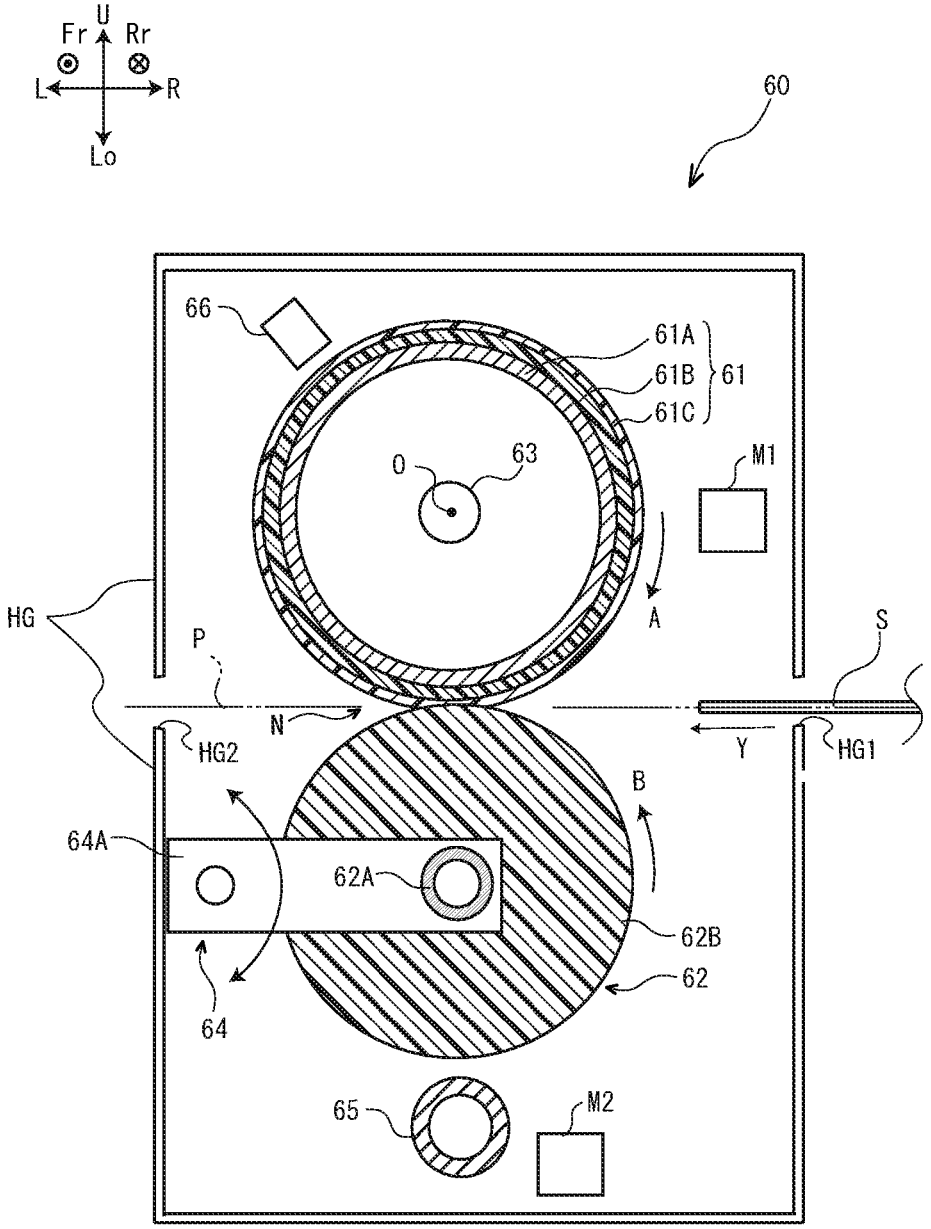
FIG. 4A is a front sectional view schematically showing a fixing device, in a state when forming a nip, in the image forming apparatus according to the first embodiment.
Figure 4B:
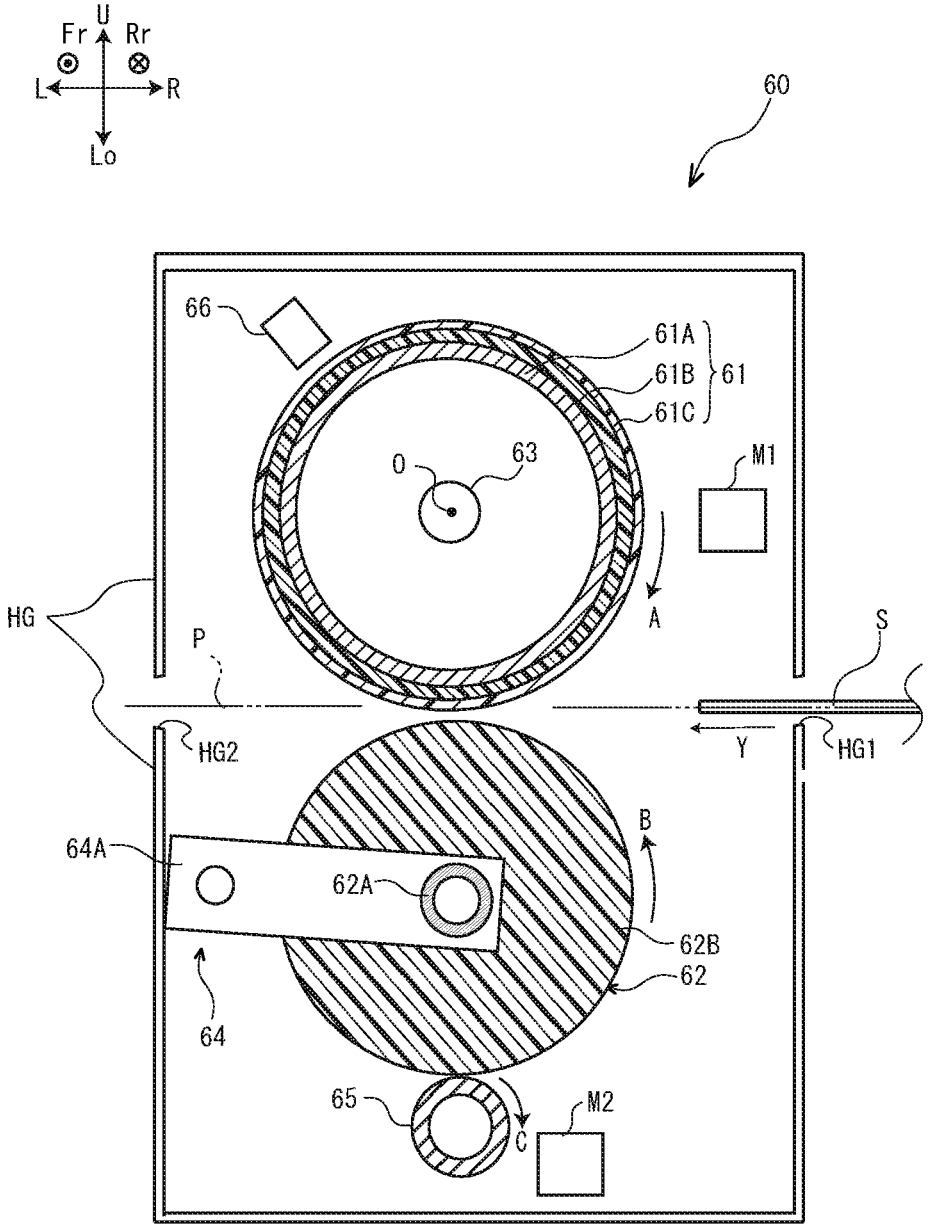
FIG. 4B is a front sectional view schematically showing a fixing device, in a state when not forming a nip (when cooling), in the image forming apparatus according to the first embodiment.

Next, the structure of the fixing device 60 as the main component of the embodiment will be described in detail with reference to FIGS. 4A and 4B.

The fixing device 60 is configured to include a heating roller 61 (one example of a heating body), a pressuring roller 62 (one example of a pressuring body), a heating source 63, a moving mechanism 64 (one example of a moving part), a cooling roller 65 (one example of a cooling body, one example of a rotating body), a temperature sensor 66, a housing HG, a motor M1 (one example of a driving source, a first motor), a motor M2 (a second motor) and a pair of lateral plates (not shown). The heating roller 61, the pressuring roller 62, the cooling roller 65 and the heating source 63 have respective longitudinal sizes and are positioned to the pair of lateral plates in a state that respective longitudinal directions are parallel to the apparatus depth direction. Moreover, the fixing device 60 has a longitudinal size and is attached to the main body 20 of the image forming apparatus 10 in a state that its longitudinal direction is parallel to the apparatus depth direction (refer to FIG. 1). Incidentally, components composing the fixing device 60 other than the housing HG are housed inside the housing HG.

The heating roller 61 has a function heating the toner image (a toner composing it) formed on the medium S by the toner image forming part 50 and the medium S. The heating roller 61 is a roller configured to include a elongated pipe 61A, an elastic layer 61B covering an outer circumference of the pipe 61A, and a surface layer 61C covering an outer circumference of the elastic layer 61B. That is, the heating roller 61 is endless. Incidentally, the surface 61C is, as one example, a layer made of PFA (tetrafluoroethylene/perfluoroalkylvinylether copolymer).

Figure 3:
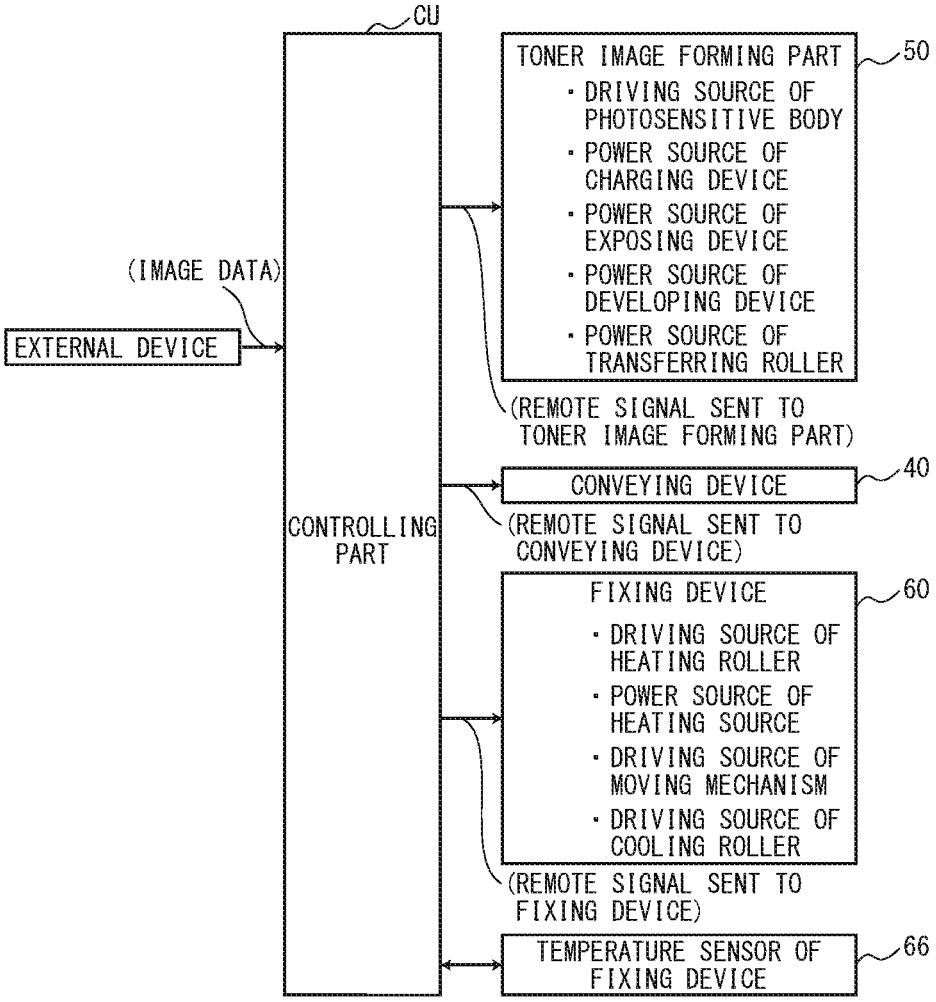
FIG. 3 is a block diagram showing a relationship of a controlling part composing the image forming apparatus according to the first embodiment and components composing the image forming apparatus.

The heating roller 61 is heated by the heating source 63 described later, and simultaneously, driven by the motor M1 to rotate (to circulate) around an axis. Here, reference code O in FIG. 3 is the axis (a rotation center) of the heating roller 61 and an arrow A is a rotating direction of the heating roller 61. Moreover, the heating roller 61 pressures, with the pressuring roller 62 at a nip N described later, the medium S having the formed toner image conveyed by the conveying device 40. As a result, the heating roller 61 rotates around the axis, and simultaneously, comes into contact with the medium S having the formed toner image, heats the medium S, and pressures, with the pressuring roller 62, the medium S passing through the nip N with the pressuring roller 62, and thereby, fixes the toner image onto the medium S.

In parts at both ends of the heating roller 61, flanges (not shown) are fitted and the heating roller 61 is glued and fixed to each flange. Moreover, the respective flanges are rotatably supported, via a shaft (not shown) fitted to them, to the pair of lateral plates 63. Incidentally, the motor M1 is connected to one end side of the shaft (not shown) to transmit its torque to the shaft. That is, the motor M1 rotates any one of the heating roller 61 and the pressuring roller 62.

The pressuring roller 62 has a function pressuring, with the heating roller 61, the toner image (the toner composing it) formed on the medium S by the toner image forming part 50 and the medium S. The pressuring roller 62 is a roller composed of an elongated shaft 62A and a covering layer 62B covering an outer circumference of the shaft 62A and having elasticity. The pressuring roller 62 is located at a lower side of the heating roller 61 as viewed in the apparatus depth direction. Moreover, in a state that the pressuring roller 62 forms the nip N together with the heating roller 61 (refer to FIG. 4A), an upper side portion of the pressuring roller 62 comes into contact with a lower side portion of the heating roller 61 depressed along an outer circumference of the heating roller 61.

The shaft 62A is rotatably supported with its both ends to the moving mechanism described later. Then, the pressuring roller 62 is rotated by following the heating roller 61 in a state forming the nip N. Here, an arrow B in FIG. 3 directs a rotation direction of the heating roller 61.

The heating source 63 has a function giving heat for heating the medium S by the heating roller 61 to the heating roller 61. The heating source 63 is, as one example, a bar-like halogen lamp. The heating source 63 is located inside the heating roller 61 and faces to an inner circumference of the heating roller 61 in a state that its own axis is overlapped with an axis O. Then the heating source 63 gives heat to the heating roller 61 when voltage is applied from a power source (not shown).

The moving mechanism 64 has a function rotatably supporting the pressuring roller 62 and a function separating the pressuring roller 62 from the heating roller 61. The moving mechanism 64 includes a pair of supporting plates 64A supporting portions at both end sides of the shaft 62A and a driving source (refer FIG. 3) swinging the supporting plates 64A within a range of predetermined angles. Then, the moving mechanism 64 swings the pressuring roller 62 within a range from a contact position with the heating roller 61 (a position for forming the nip N, refer to FIG. 4A) to a contact position with the cooling roller 65 described later (refer to FIG. 4B) to move the pressuring roller 62 from one to another of the two contact positions. On the other words, the moving mechanism 64 moves the pressuring roller 62 relatively to the heating roller 61.

The cooling roller 65 has a function cooling the pressuring roller 62 (taking heat of the pressuring roller 62) at a position separated from the heating roller 61. The cooling roller 65 is, as shown in FIGS. 4A and 4B, located at an opposite side to the heating roller 61 across the pressuring roller 62. The cooling roller 65 is, as one example, a metal pipe, and is rotatably supported to the pair of lateral plates. Moreover, by connecting the motor M2 to one end side of the cooling roller 65, the cooling roller 65 is rotated around an axis by torque from the motor M2. Incidentally, the cooling roller 65 rotates around the axis by the motor M2, and simultaneously, cools the pressuring roller 62, for a period of contacting with the pressuring roller 62.

The temperature sensor 66 has a function sensing temperature of the heating roller 61. The temperature sensor 66 is, as one example, located so as to face to the outer circumference of the heating roller 61. The temperature sensed by the temperature sensor 66 is transmitted to the controlling part CU in a predetermined cycle.

Next, the fixing steps of the fixing device 60 will be described with reference to FIGS. 3-7.

The controlling part CU transmits a remote signal to the fixing device 60 (refer to FIG. 3) when receiving the image data from the external device (refer to FIG. 3). Moreover, the controlling part CU controls the moving mechanism 64 so as to move the pressuring roller 62 positioned at the contact position with the cooling roller 65 as an initial position (a position before the fixing steps) to a portion for forming the nip N with the heating roller 61 by the moving mechanism 64. Moreover, the controlling part CU controls drive of the motor M1 (refer to FIGS. 2, 4A and 4B) of the heating roller 61 to rotate the heating roller 61. According to this, the pressuring roller 62 is driven by the heating roller 61 and rotated. Further, the controlling part CU controls to apply voltage of the power source to the heating source 63 and to start giving heat to the heating roller 61 by the heating source 63. Incidentally, the controlling part CU changes voltage applied to the heating source 63 on the basis of data relating to temperature sensed by the temperature sensor and transmitted from the temperature sensor 66, and thereby, temperature of the heating roller 61 is adjusted so as to become predetermined heating temperature (refer to FIG. 3).

Figure 5:
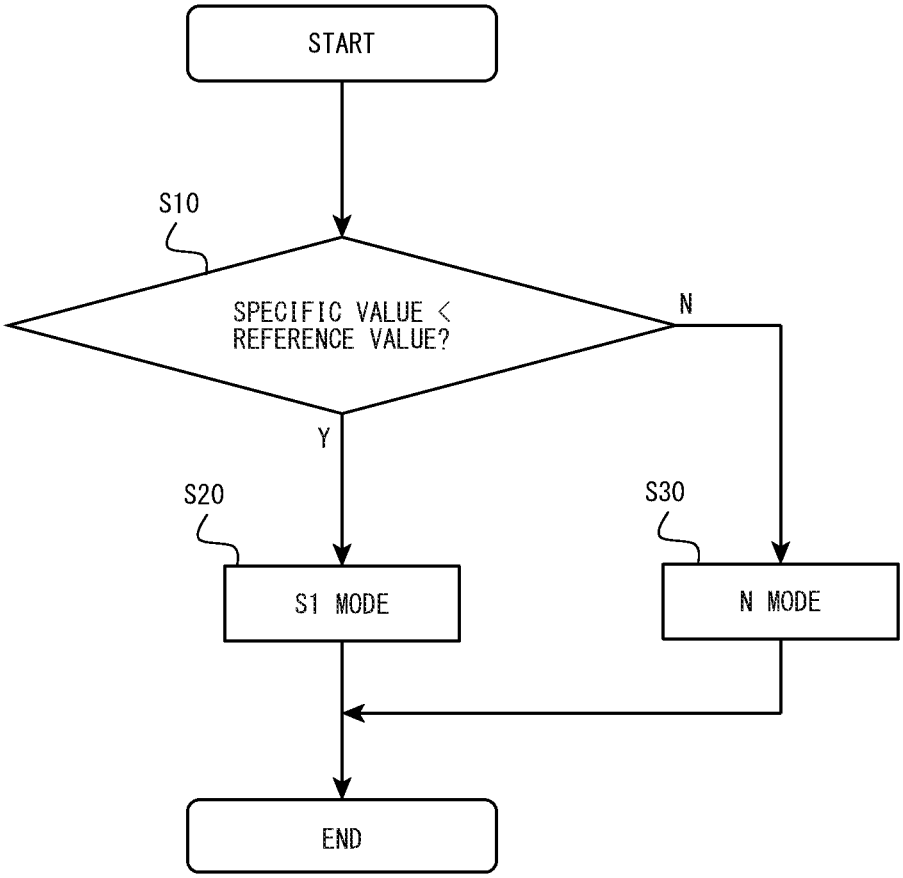
FIG. 5 is a chart of a control flow showing a selection flow of a mode in the fixing device of the first embodiment.

Here, the controlling part CU determines a position of the pressuring roller 62 by the moving mechanism 64 in accordance with a control flow shown in FIG. 5. Concretely, it will be described as follows.

First, the controlling part CU, when receiving the image data from the external device (refer to FIG. 3), decides at a timing transmitting the remote signal to the fixing device 60, i.e., in a case where fixing operation is carried out this time, whether or not a specific value described later is smaller than a predetermined reference value described later (a decision step S10). Here, the specific value is a value obtained in the last fixing operation by dividing a passing period when the medium S passes through the nip N by a rotating period when the heating roller 61 is rotated by the motor M1 (refer to FIG. 6B). Moreover, the predetermined reference value is predetermined standard. As a result, if the decision step S10 results in positive, i.e., the specific value is smaller than the predetermined reference value in the case where the fixing operation is carried out this time, the controlling part CU makes the fixing device 60 execute the fixing operation of a special mode (S1 mode) (step S20). By contrast, if the decision step S10 results in negative, i.e., the specific value is equal to or more than the predetermined reference value in the case where the fixing operation is carried out this time, the controlling part CU makes the fixing device 60 execute the fixing operation of a normal mode (N mode) (step S30).

Figure 6A:
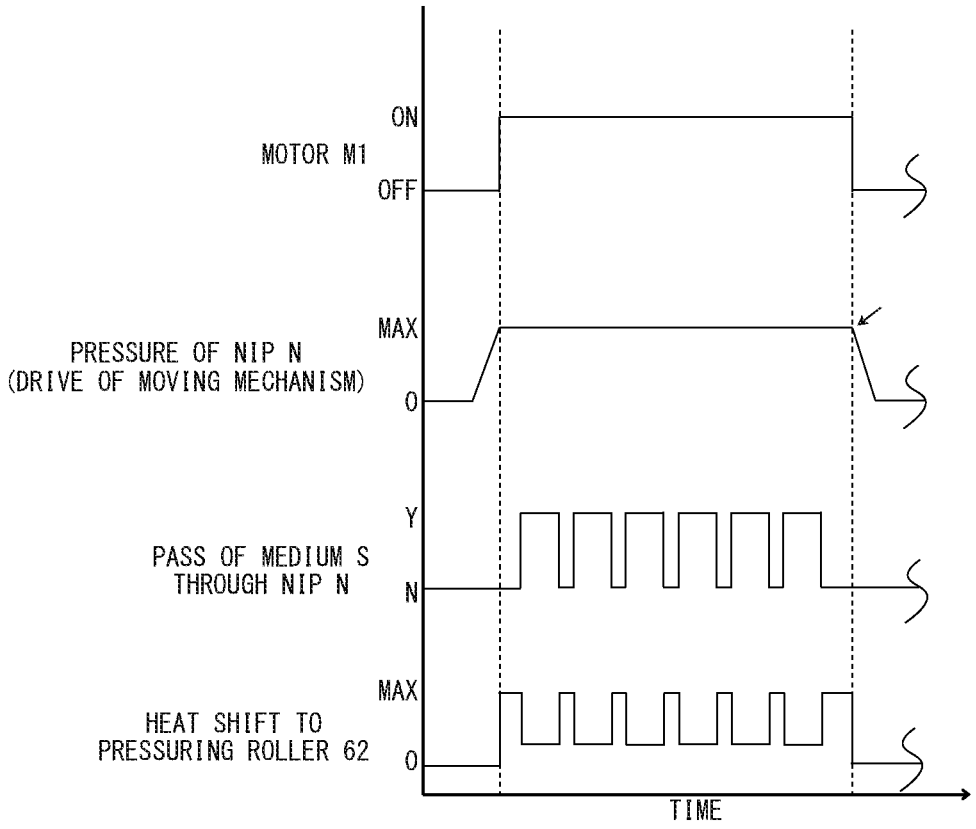
FIG. 6A is a timing chart showing fixing operation processing a plurality of mediums with once job in a case of a normal mode in the fixing device of the first embodiment.
Figure 6B:
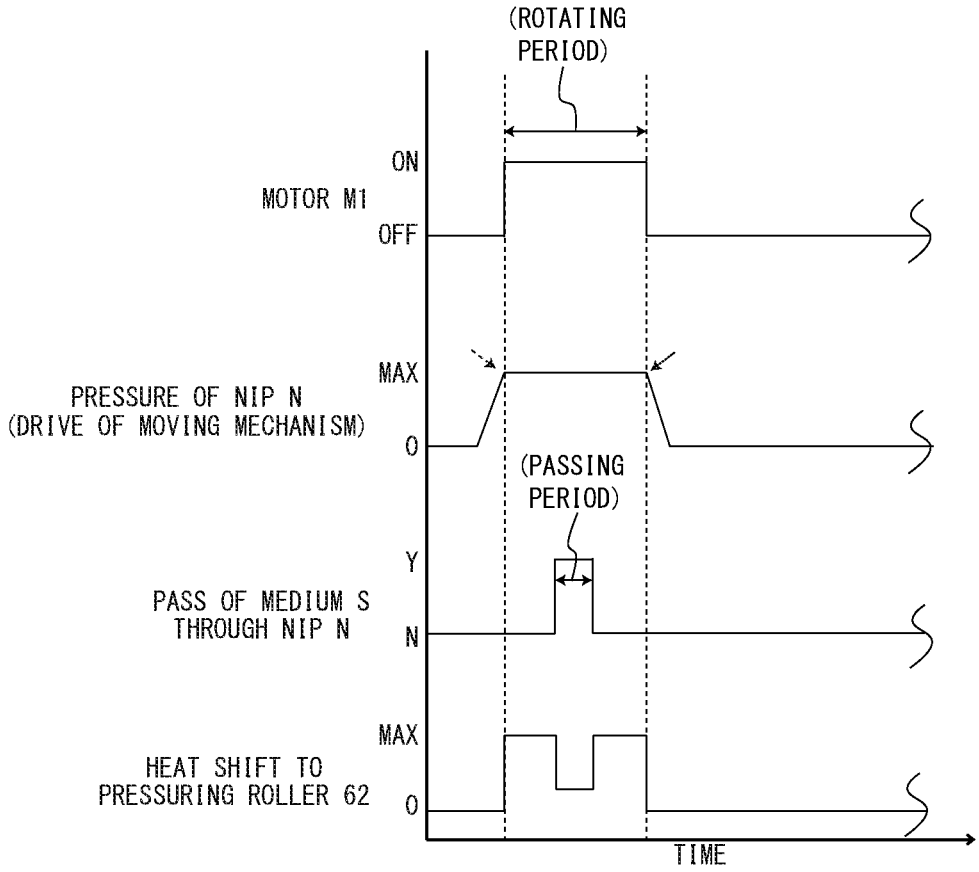
FIG. 6B is a timing chart showing fixing operation processing a single medium with once job in a case of the normal mode in the fixing device of the first embodiment.
Figure 7:
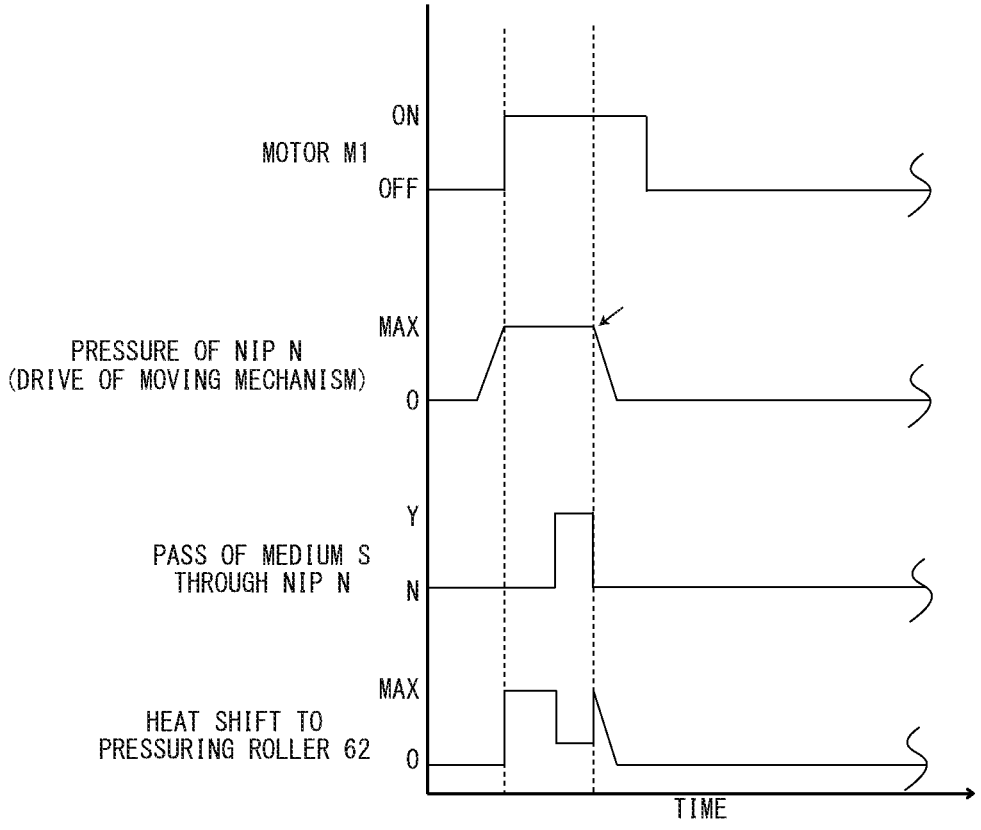
FIG. 7 is a timing chart showing fixing operation processing a single medium with once job in a case of a special mode in the fixing device of the first embodiment.

Here, the controlling part CU operates the moving mechanism 64, in a case of the N mode, as shown in FIG. 6A as one example in a case where the toner images are fixed onto a plurality of mediums S or as shown in FIG. 6B as one example in a case where the toner image is fixed onto one medium S, in the fixing operation. By contrast, the controlling part CU operates the moving mechanism 64, in a case of the S1 mode, as shown in FIG. 7 as one example in a case where the toner image is fixed onto one medium S, in the fixing operation. That is, in the case of the S1 mode, the controlling part CU makes a timing separating the pressuring roller 62 from the heating roller 61 after the medium S passes through the nip N early in comparison with the N mode. On the other words, the controlling part CU controls the moving mechanism 64 so that the timing (a part indicated by an arrow in FIG. 7), in the case of the S1 mode, separating the pressuring roller 62 from the heating roller 61 after the medium S passes through the nip N is made earlier than the timing (a part indicated by an arrow in FIGS. 6A and 6B), in the case of the N mode, separating the pressuring roller 62 from the heating roller 61 after the medium S passes through the nip N.

Then, the medium S having the formed toner image passes through the nip N while being conveyed by the conveying device 40. The medium S is heated by the heating roller 61 and pressured by the heating roller 61 and the pressuring roller 62 when passing through the nip N, and thereby the toner image is fixed.

Subsequently, the controlling part CU stops operation of each component of the fixing device 60 at a timing when the medium S passes through the nip N and is ejected from an outlet HG2 (refer to FIG. 2) of the housing HG, and then, the fixing operation of each mode is completed.

Next, effects of the embodiment will be described.

For example, in the case where the fixing operation is carried out this time, the toner offset and adhered from the medium S to the heating roller 61 at the nip N may be rotated together with the heating roller 61 and shifted to the pressuring roller 62 at the nip N (so-called as a timing between mediums). Then, in a situation that the toner shifted from the heating roller 61 is adhered to the pressuring roller 62, if the pressuring roller 62 is naturally cooled, in a case where the fixing operation is carried out next time, it is feared that the toner adhered to the pressuring roller 62 is shifted to the heating roller 61 at the nip N, transferred and fixed onto a fixing face of the medium S on which the toner should be fixed, and occurs fixing failure. Particularly, according to examination and research by inventers of the present application, it is known that the above-described fixing failure easily occurs in a case the specific value as described above is smaller than the reference value as described above in the last fixing operation.

Thereupon, in a case of the embodiment, in the case where the fixing operation is carried out this time, when the specific value as described above is smaller than the reference value as described above in the last fixing operation (when the decision step S10 in the control flow in FIG. 5 results in positive), as shown in the control flow in FIG. 5, the S1 mode is selected at step S20 and the fixing operation is carried out. Then, in the embodiment, in the case where the fixing operation is carried out this time, when the specific value as described above is smaller than the reference value as described above in the last fixing operation, i.e., in a case where the above-described fixing failure easily occurs, the timing separating the pressuring roller 62 from the heating roller 61 after the medium S passes through the nip N is made early in comparison with the case of N mode (a normal case). As a result, in the embodiment, in comparison with a case where a separating timing similar to the case of the N mode is applied in the case where the specific value as described above is smaller than the reference value as described above in the last fixing operation, heat is hardly shifted from the pressuring roller 62 to the heating roller 61. According to this, in the embodiment, the toner accumulated in the pressuring roller 62 is reduced.

Therefore, in accordance with the fixing device 60 of the embodiment, in a configuration the pressuring roller 62 is moved relatively to the heating roller 61 to separate the pressuring roller 62 from the heating roller 61 at a predetermined timing after the medium S passes through the nip N, it is possible to reduce a toner quantity shifted from the heating roller 61 to the pressuring roller 62 and accumulated in the pressuring roller 62. According to this, in the image forming apparatus 10 of the embodiment, it is possible to restrain image forming failure according to increase of the toner quantity shifted from the heating roller 61 to the pressuring roller 62 and accumulated in the pressuring roller 62.

Moreover, in the case of the embodiment, the pressuring roller 62 is moved by the moving mechanism 64 and driven by the cooling roller 65. Therefore, in the fixing device 60 of the embodiment, cooling efficiency is high in comparison with a case where the cooling roller 65 is not rotated, i.e., a case where the pressuring roller 62 is not rotated and driven by the cooling roller 65 when cooling. In addition, without including an exclusive driving mechanism for the pressuring roller 62, the fixing operation and cooling operation can be carried out.

Next, a second embodiment (the mechanical structure is similar to the first embodiment, and then, refer to FIGS. 1-4A and 4B) will be described with reference to FIGS. 8 and 9 about differences from the first embodiment.

The embodiment has the differences modifying the decision step S10 of the control flow (refer to FIG. 5) of the first embodiment to a decision step S10A (refer to FIG. 8) and executing a special mode (S2 mode) different from the first embodiment in a case where the modified decision step 10A results in positive. Concretely, the controlling part CU carries out the control flow of the embodiment as follows. That is, the controlling part CU decides whether or not the fixing operation carried out this time is carried out within a predetermined period from completion of the last fixing operation (decision step S10A). As a result, in a case where the decision step S10A results in positive, i.e., in a case where the fixing operation carried out this time is carried out within the predetermined period from completion of the last fixing operation, the controlling part CU makes the fixing device 60 execute the fixing operation of the special mode (S2 mode) (step S20A). By contrast, if the decision step S10A results in negative, the controlling part CU makes the fixing device 60 execute the fixing operation of the normal mode (N mode similar to the first embodiment) (step S30A).

Here, in the case of the S2 mode, the controlling part CU makes a timing contacting the pressuring roller 62 with the heating roller 61 before the medium S reaches the nip N late in comparison with the N mode. On the other words, the controlling part CU controls the moving mechanism 64 so that the timing (a part indicated by an arrow in FIG. 9), in the case of the S2 mode, contacting the pressuring roller 62 with the heating roller 61 before the medium S reaches the nip N is made later than the timing (a part indicated by an arrow in FIG. 6B), in the case of the N mode, contacting the pressuring roller 62 with the heating roller 61 before the medium S reaches the nip N.

Next, effects of the embodiment will be described.

For example, the case where the fixing operation carried out this time is carried out within the predetermined period from completion of the last fixing operation corresponds to a situation that heat is shifted from the heating roller 61 to the pressuring roller 62 when the last fixing operation and surface temperature of the pressuring roller 62 is raised. In such a case, if the fixing operation is repeated in a condition similar to the normal mode (N mode), the toner adhered to the pressuring roller 62 is accumulated in the pressuring roller 62 just as it is. Then, in a case where the fixing operation is carried out next time, it is feared that the toner accumulated in the pressuring roller 62 is shifted to the heating roller 61 and the above-described fixing failure occurs.

Figure 8:
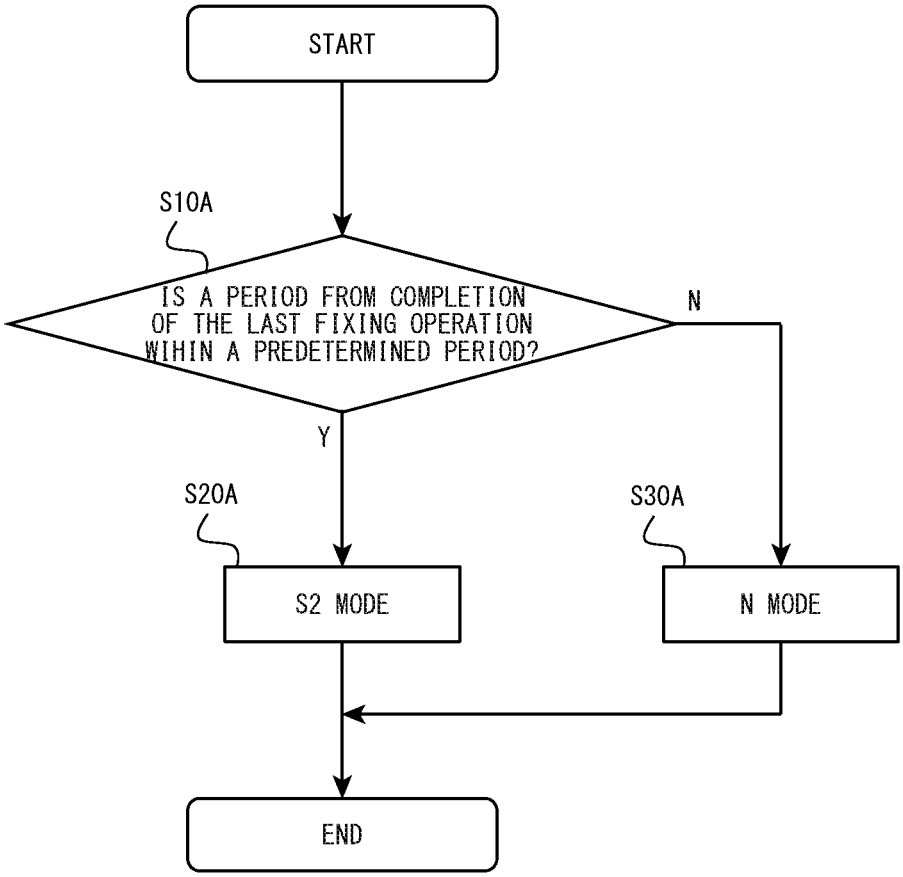
FIG. 8 is a chart of a control flow showing a selection flow of a mode in a fixing device of a second embodiment of the present disclosure.
Figure 9:
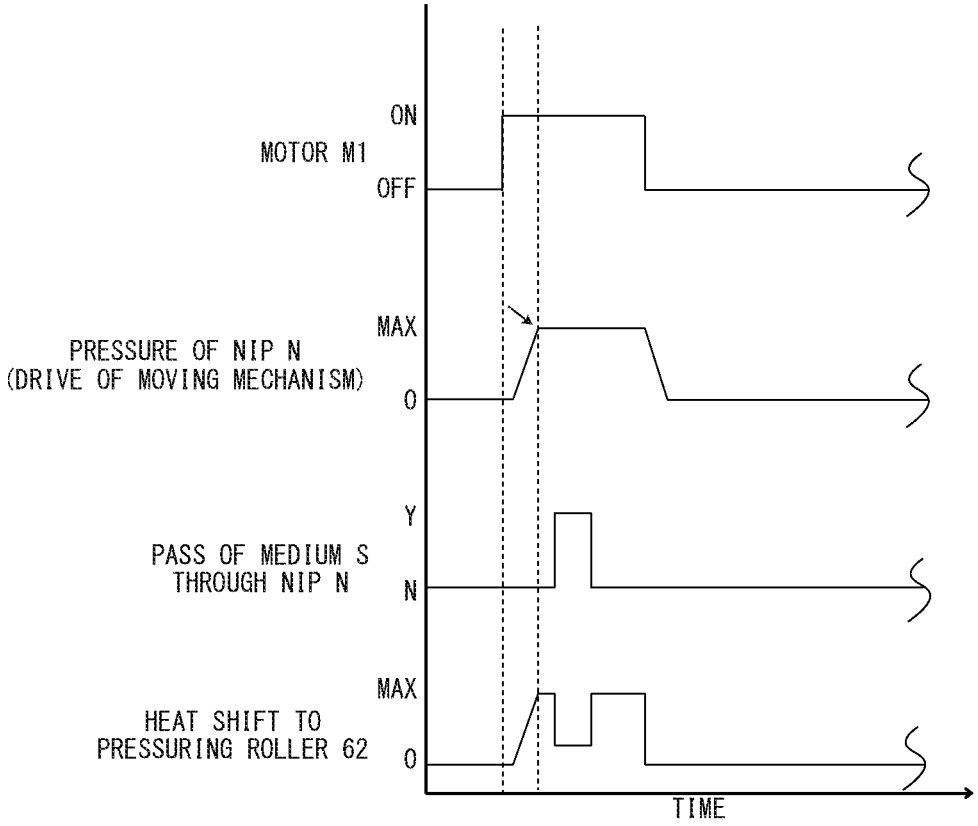
FIG. 9 is a timing chart showing fixing operation processing a single medium with once job in a case of a special mode in the fixing device of the second embodiment.

By contrast, in the embodiment, in the case where the fixing operation carried out this time is carried out within the predetermined period from completion of the last fixing operation, the controlling part CU decides positive at the decision step S10A in the control flow in FIG. 8 and executes the special mode (S2 mode). That is, in the embodiment, in a case where the above-described fixing failure easily occurs, the timing contacting the pressuring roller 62 with the heating roller 61 before the medium S reaches the nip N is made later in comparison with the case of N mode (a normal case). As a result, in the embodiment, in comparison with a case where a contacting timing similar to the case of the N mode is applied in the case where a period from completion of the last fixing operation to this time is longer than the predetermined period, heat is hardly shifted from heating roller to the pressuring roller 62. According to this, in the embodiment, the toner accumulated in the pressuring roller 62 is reduced.

Therefore, in accordance with the fixing device 60 of the embodiment, in a configuration the pressuring roller 62 is moved relatively to the heating roller 61 to separate the pressuring roller 62 from the heating roller 61 at a predetermined timing after the medium S passes through the nip N, it is possible to reduce a toner quantity shifted from the heating roller 61 to the pressuring roller 62 and accumulated in the pressuring roller 62. According to this, in the image forming apparatus 10 of the embodiment, it is possible to restrain image forming failure according to increase of the toner quantity shifted from the heating roller 61 to the pressuring roller 62 and accumulated in the pressuring roller 62.

Next, a third embodiment (the mechanical structure is similar to the first and second embodiments, and then, refer to FIGS. 1-4A and 4B) will be described with reference to FIGS. 10 and 11 about differences from the first and second embodiments.

Figure 10:
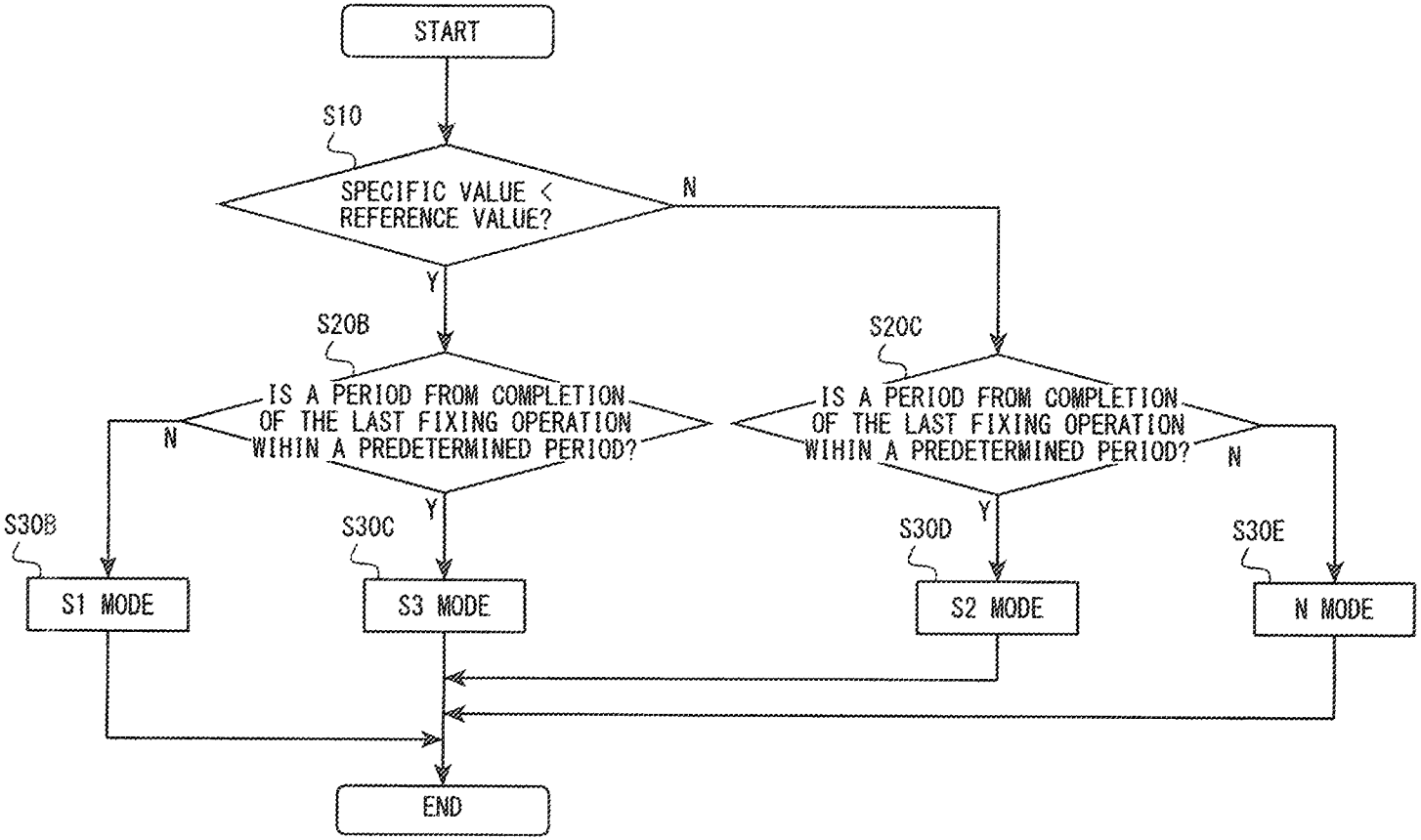
FIG. 10 is a chart of a control flow showing a selection flow of a mode in a fixing device of a third embodiment of the present disclosure.
Figure 11:
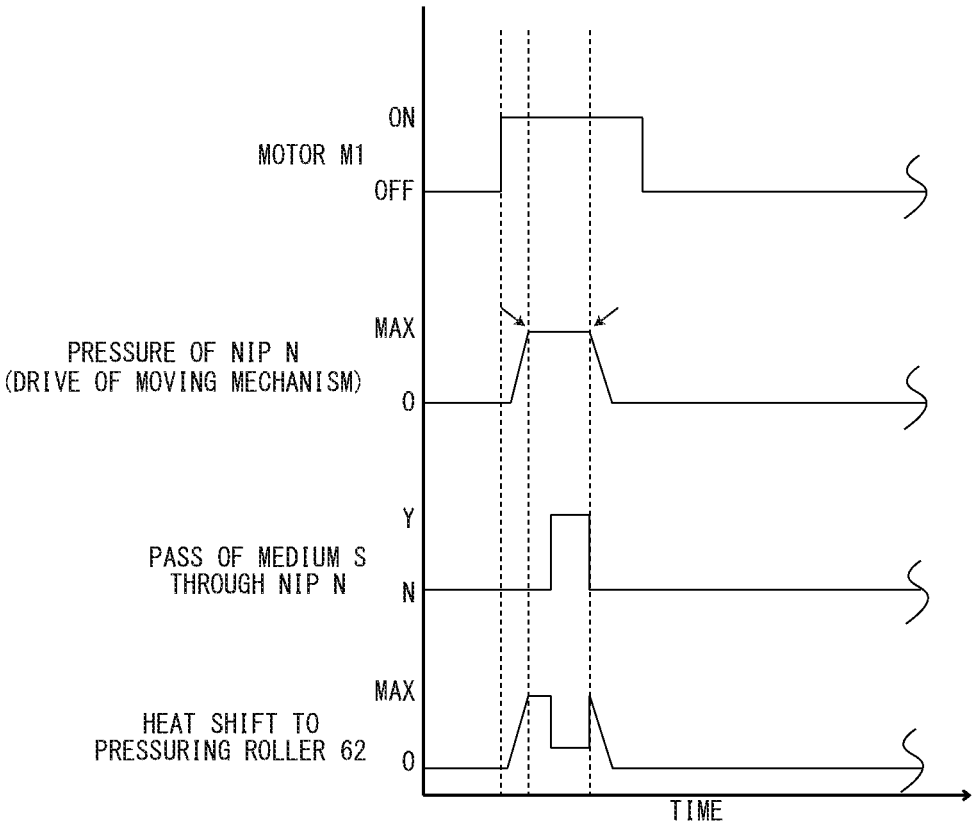
FIG. 11 is a timing chart showing fixing operation processing a single medium with once job in a case of a special mode in the fixing device of the third embodiment.

In a case of the embodiment, the control flow selecting each mode is carried out as shown in a control flow in FIG. 10. That is, first, the decision step S10 is carried out similarly to the first embodiment. As a result, in a case where the decision step S10 results in positive, similar decision to the decision step S10A of the second embodiment is carried out at a decision step S20B. In a case where the decision step S20B results in negative, the special mode (S1 mode) is selected at step S30B similarly to step S20 of the first embodiment. By contrast, in a case where the decision step S20B results in positive, a special mode (S3 mode) described later is selected at step S30C. Moreover, in a case where the decision step S10 results in negative, similar decision to the decision step S10A of the second embodiment is carried out at a decision step S20C. As a result, in a case where the decision step S20C results in positive, the special mode (S2 mode) is selected at step S30D similarly to step S20A of the second embodiment. Further, in a case where the decision step S20C results in negative, the normal mode (N mode) is selected at step S30E similarly to step S30 of the first embodiment and step S30A of the second embodiment. Differences of the embodiment from the first and second embodiments are described above. That is, in the embodiment, the first and second embodiments are simultaneously carried out. In addition, in the embodiment, in a case where step S30C is finally selected, the special mode (S3 mode) is executed. Here, the S3 mode is, as shown in FIG. 11, a mode executing the S1 mode of the first embodiment and the S2 mode of the second embodiment. That is, the timing (a first timing) separating the pressuring roller 62 from the heating roller 61 in comparison with a case where the specific value is equal to or more than the reference value, and the timing (a second timing) contacting the pressuring roller 62 with the heating roller 61 in comparison with a case where the period from completion of the last fixing operation to this time is longer than the predetermined period (refer to two arrows in FIG. 11).

In the embodiment, in a case where the decision step S10 of the first embodiment results in positive and the decision step S10A of the second embodiment results in positive, i.e., in a case where step S30 is selected in the control flow (refer to FIG. 11) of the embodiment, it is possible to achieve a synergetic effect due to execution of the S3 mode having harmonization of the S1 mode and the S2 mode.

Although, as described above, the present disclosure was described by citing the present embodiment as an example, the technical scope of the present disclosure is not restricted by the present embodiment. For example, in the technical scope of the present disclosure, the following embodiment is included.

Figure 12A:
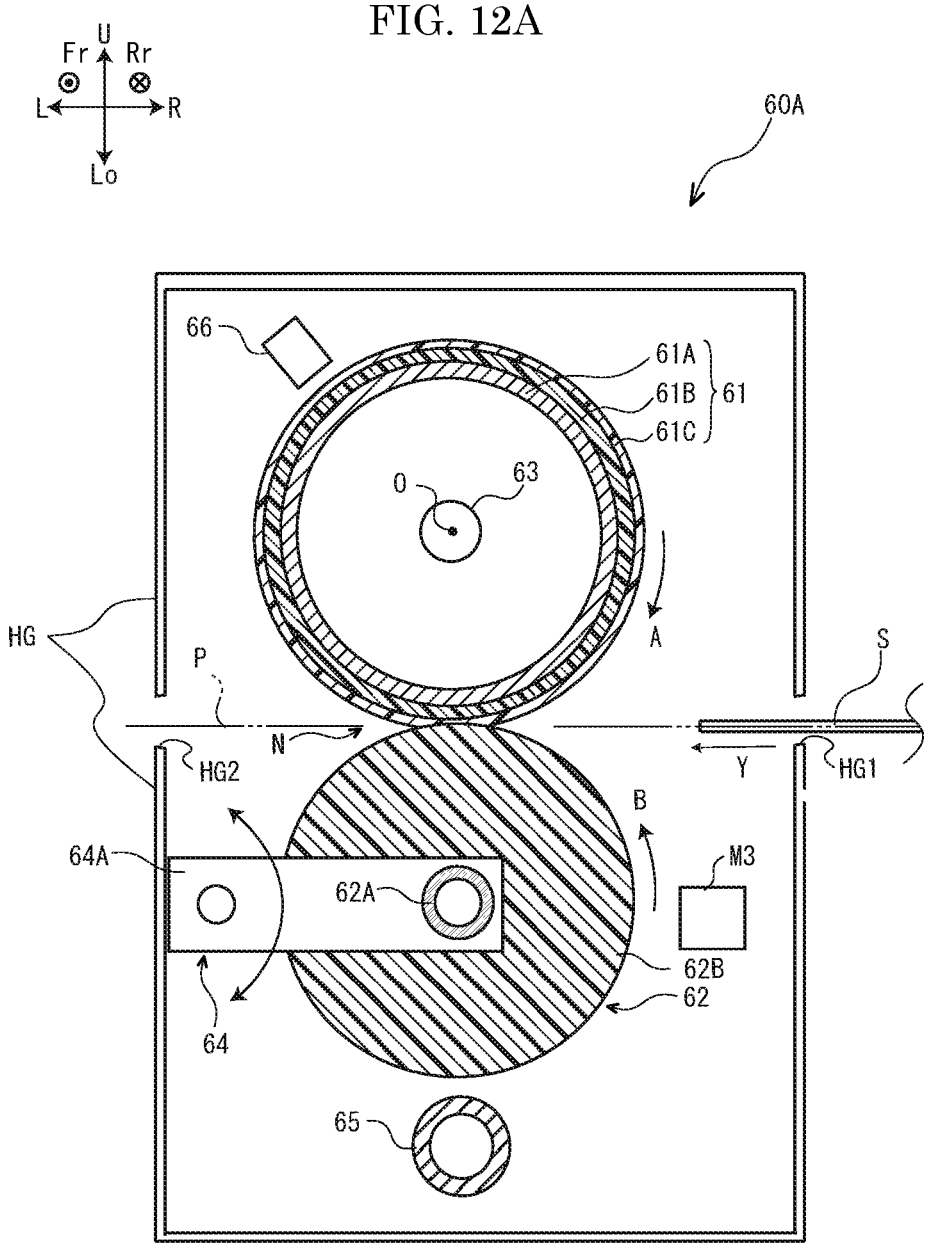
FIG. 12A is a front sectional view schematically showing a fixing device composing an image forming apparatus according to a first modified example of the present disclosure.

For example, the present embodiment was described so that one example of the driving source is the motor M1 driving the heating roller 61. However, as a motor M3 (one example of the driving source) of a fixing device 60A of a modified example in FIG. 12A, it may drive and rotate the pressuring roller 62. In such a case, the heating roller 61 and the cooling roller 65 may be circulated or rotated by following rotation of the pressuring roller 62.

Figure 12B:
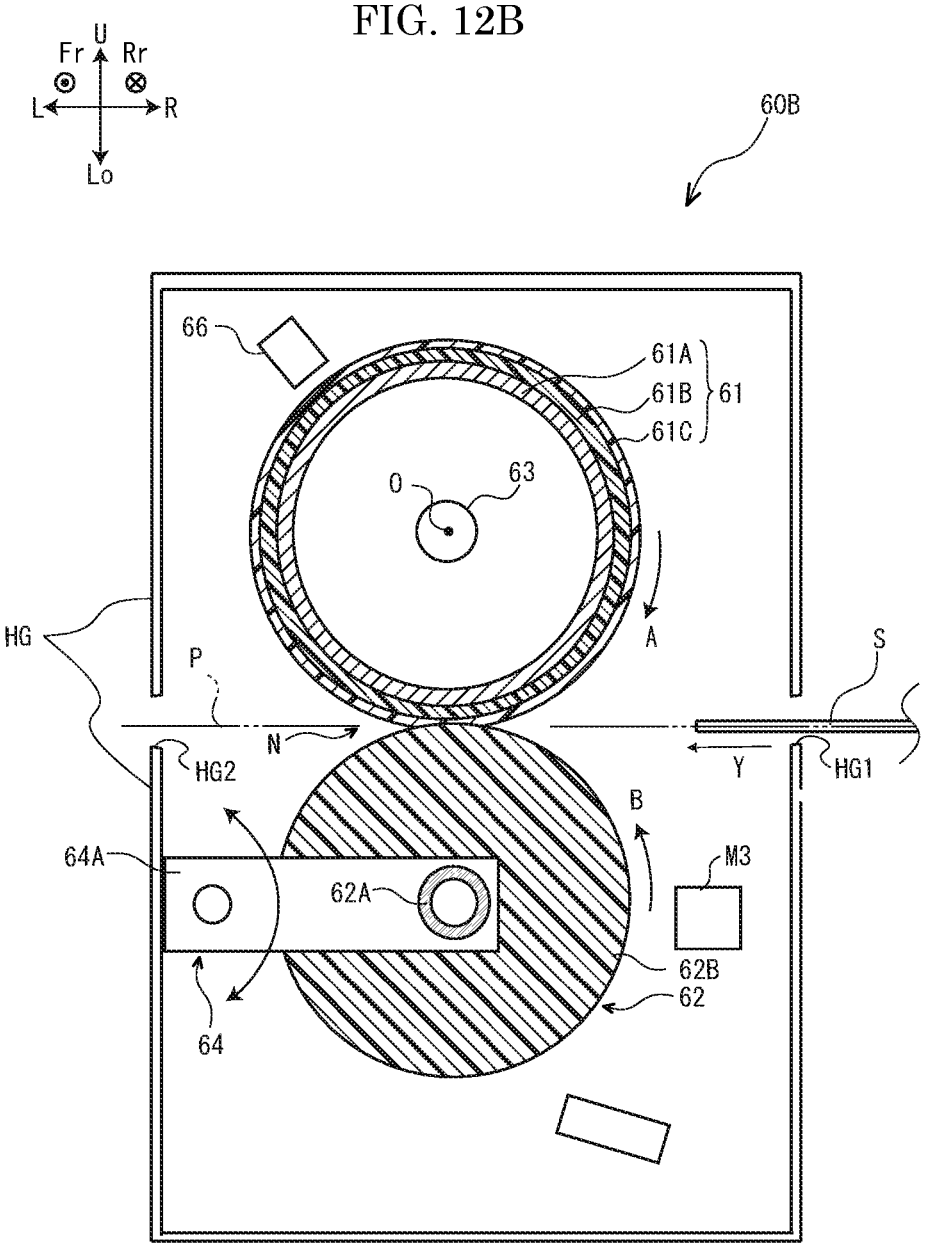
FIG. 12B is a front sectional view schematically showing a fixing device composing an image forming apparatus according to a second modified example of the present disclosure.

Moreover, the present embodiment was described so that one example of the cooling part is the cooling roller 65. However, as a cooling fan of a fixing device 60B of a modified example in FIG. 12B, it may be one for cooling the pressuring roller 62.

Figure 12C:
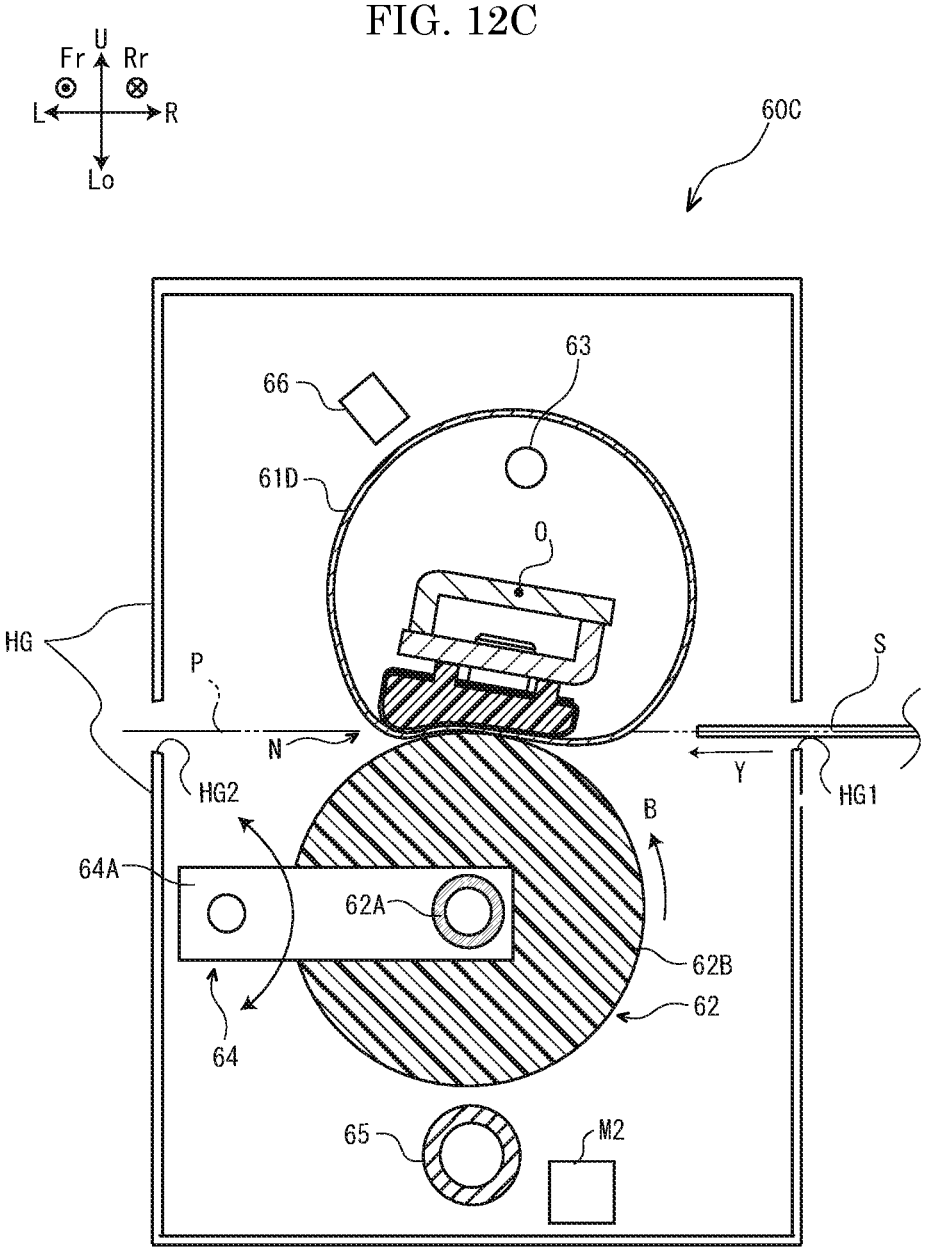
FIG. 12C is a front sectional view schematically showing a fixing device composing an image forming apparatus according to a third modified example of the present disclosure.

Further, the present embodiment was described so that one example of the heating body is the heating roller 61. However, the heating body may not be a roller. For example, as a fixing device 60C of a modified example in FIG. 12C, the heating body may be a heating belt 60D.

The configuration of the present disclosure may be applied to any one of various image forming apparatuses 10, such as a printer, a copying machine, a facsimile or a multifunction peripheral, and to the fixing device 60 provided in it.

Incidentally, the above-description of the embodiments was described about one example of the fixing device and the image forming apparatus including this according to the present disclosure. However, the technical scope of the present disclosure is not limited to the embodiments. Components in the embodiment described above can be appropriately exchanged with existing components, and various variations including combinations with other existing components are possible. The description of the embodiment described above does not limit the content of the disclosure described in the claims.

The invention claimed is:

1. A fixing device comprising:

a heating body being rotated and contacting with a medium, on which a toner image is formed, to heat the medium;

a heating source giving heat for heating the medium by the heating body to the heating body;

a pressuring body being rotated and forming a nip with the heating body to pressure the medium passing through the nip;

a driving source rotating one body of the heating body and the pressuring body;

a moving part moving the pressuring body relatively to the heating body at a predetermined timing after the medium passes through the nip to separate the pressuring body from the heating body; and a cooling part cooling the pressuring body at a position where the pressuring body is separated from the heating body;

wherein, in a case where fixing operation is carried out in a condition that a specific value, which is obtained in the last fixing operation by dividing a passing period when the medium passes through the nip by a rotating period when the one body is rotated by the driving source, is smaller than a predetermined reference value, the timing is made early in comparison with a case where the specific value is equal to or more than the reference value.

2. The fixing device according to claim 1, wherein the timing is a first timing, the moving part moves the pressuring body relatively to the heating body at a predetermined second timing before the medium reaches the nip to contact the pressuring body with the heating body, in a case where fixing operation is carried out in a condition that a specific value, which is obtained in the last fixing operation by dividing a passing period when the medium passes through the nip by a rotating period when the one body is rotated by the driving source, is smaller than a predetermined reference value and in a condition of being carried out within a predetermined period from completion of the last fixing operation, the first timing is made early in comparison with a case where the specific value is equal to or more than the reference value and the second timing is made late in comparison with a case where a period from completion of the last fixing operation to this time is longer than the predetermined period.

3. An image forming apparatus comprising:

a forming part forming a toner image onto a medium; and the fixing device according to claim 2 heating and pressuring the medium, on which the toner image is formed by the forming part, to fix the toner image onto the medium.

4. The fixing device according to claim 1, wherein the cooling part is a rotating body rotating around an axis.

5. The fixing device according to claim 4, wherein the driving source is composed of a first motor rotating the heating body, the pressuring body is rotated by following the heating body, the rotating body is rotated by a second motor.

6. An image forming apparatus comprising:

a forming part forming a toner image onto a medium; and the fixing device according to claim 5 heating and pressuring the medium, on which the toner image is formed by the forming part, to fix the toner image onto the medium.

7. The fixing device according to claim 4, wherein the driving source rotates the pressuring body, the heating body is rotated by following the pressuring body and the rotating body is rotated by following the pressuring body.

8. An image forming apparatus comprising:

a forming part forming a toner image onto a medium; and the fixing device according to claim 7 heating and pressuring the medium, on which the toner image is formed by the forming part, to fix the toner image onto the medium.

9. An image forming apparatus comprising:

a forming part forming a toner image onto a medium; and the fixing device according to claim 4 heating and pressuring the medium, on which the toner image is formed by the forming part, to fix the toner image onto the medium.

10. An image forming apparatus comprising:

a forming part forming a toner image onto a medium; and the fixing device according to claim 1 heating and pressuring the medium, on which the toner image is formed by the forming part, to fix the toner image onto the medium.

11. A fixing device comprising:

a heating body being rotated and contacting with a medium, on which a toner image is formed, to heat the medium;

a heating source giving heat for heating the medium by the heating body to the heating body;

a pressuring body being rotated and forming a nip with the heating roller body to pressure the medium passing through the nip;

a driving source rotating one body of the heating body and the pressuring body;

a moving part moving the pressuring body relatively to the heating body at a predetermined timing before the medium reaches the nip to contact the pressuring body with the heating body; and a cooling part cooling the pressuring body at a position where the pressuring body is separated from the heating body;

wherein, in a case where fixing operation is carried out in a condition of being carried out within a predetermined period from completion of the last fixing operation, the timing is made late in comparison with a case where a period from completion of the last fixing operation to this time is longer than the predetermined period.

12. The fixing device according to claim 11, wherein the cooling part is a rotating body rotating around an axis.

13. The fixing device according to claim 12, wherein the driving source is composed of a first motor rotating the heating body, the pressuring body is rotated by following the heating body, the rotating body is rotated by a second motor.

14. An image forming apparatus comprising:

a forming part forming a toner image onto a medium; and the fixing device according to claim 13 heating and pressuring the medium, on which the toner image is formed by the forming part, to fix the toner image onto the medium.

15. The fixing device according to claim 12, wherein the driving source rotates the pressuring body, the heating body is rotated by following the pressuring body and the rotating body is rotated by following the pressuring body.

16. An image forming apparatus comprising:

a forming part forming a toner image onto a medium; and the fixing device according to claim 15 heating and pressuring the medium, on which the toner image is formed by the forming part, to fix the toner image onto the medium.

17. An image forming apparatus comprising:

a forming part forming a toner image onto a medium; and the fixing device according to claim 12 heating and pressuring the medium, on which the toner image is formed by the forming part, to fix the toner image onto the medium.

18. An image forming apparatus comprising:

a forming part forming a toner image onto a medium; and the fixing device according to claim 11 heating and pressuring the medium, on which the toner image is formed by the forming part, to fix the toner image onto the medium.

* * * * *